US006559427B1

(12) United States Patent
Barnes et al.

(10) Patent No.: US 6,559,427 B1
(45) Date of Patent: May 6, 2003

(54) PROGRAM CONTROL AND DISPLAY SYSTEM FOR MULTIPLE APPLIANCE UNITS

(75) Inventors: Shelton T. Barnes, Chattanooga, TN (US); Theodore A. Becker, Cleveland, TN (US); Perry A. Bennett, Cleveland, TN (US); Kenneth E. Sauter, Ooltewah, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/387,738

(22) Filed: Sep. 1, 1999

(51) Int. Cl.[7] ..... H05B 11/00
(52) U.S. Cl. ..... 219/486; 219/506
(58) Field of Search ..... 219/506, 492, 219/497, 501, 411–415, 453, 487, 483, 486; 99/325, 328

(56) References Cited

U.S. PATENT DOCUMENTS

| | | | | |
|---|---|---|---|---|
| 4,390,766 A | | 6/1983 | Horinouchi | |
| 4,636,621 A | | 1/1987 | McGeorge | |
| 4,761,540 A | | 8/1988 | McGeorge | |
| 5,398,597 A | | 3/1995 | Jones et al. | |
| 5,611,327 A | * | 3/1997 | Teixeira Filho et al. | 126/39 R |
| 6,018,153 A | * | 1/2000 | Matsuda et al. | 219/506 |
| 6,157,008 A | * | 12/2000 | Brown et al. | 219/486 |
| 6,255,630 B1 | * | 7/2001 | Barnes et al. | 219/486 |

* cited by examiner

*Primary Examiner*—Mark Paschall
(74) *Attorney, Agent, or Firm*—Everett G. Diederiks, Jr.

(57) ABSTRACT

Multiple, programmable appliance units are connected to a control unit which receives program data from a control panel including user input elements for selecting various operational parameters, such as operational modes and times, for the appliance units. The control panel also includes a display having both display zones which are dedicated to the individual appliance units and at least one common display zone. Preferably, the common display zone is centrally located and operates on priority and override bases to provide user information concerning the appliance units. In further accordance with the invention, the information provided in the common display zone is linked to a dedicated area for a corresponding one of the appliance units to clearly enable the user to relate the provided information with the respective unit. In a preferred form of the invention, the information link takes the form of a bracket provided on the display which extends across the common display zone and into a dedicated zone for the particular appliance unit.

20 Claims, 2 Drawing Sheets

PROGRAM CONTROL AND DISPLAY SYSTEM FOR MULTIPLE APPLIANCE UNITS

BACKGROUND OF THE INVENTION

1. Field of the Invention

The present invention pertains to the art of appliances and, more particularly, to a system used to control the programming and display for multiple appliance units.

2. Discussion of the Prior Art

Many appliances available in the marketplace today incorporate electronic controls. A typical electronically controlled appliance unit will be provided with a dedicated control system and, where applicable, a dedicated display. For one reason or another, certain appliance units are sometimes combined such as, for example, dual cooking ovens in the form of upper and lower wall ovens. Such an oven arrangement not only provides a user with an increased volume in which food items can be cooked, but advantageously enables the user to simultaneously perform distinct cooking operations. In addition, household ranges have now been introduced into the marketplace which incorporate upper and lower ovens in addition to conventional surface heating elements.

In conventional dual oven wall units, separate controls and displays are provided to enable the ovens to be used and controlled individually, as well as simultaneously. Typically, identical control and display panels are provided for the upper and lower ovens respectively, with the associated control systems functioning completely independently of one another. More modern systems generally utilize alpha-numeric displays to convey to the user programming times and the like. In any case, separate displays are provided so that the user is provided information dedicated to a particular oven.

Providing separate control and display systems can considerably add to the cost of the overall appliance. In addition, it is often the case that both ovens are not needed simultaneously. A majority of the time, only one of the ovens is, in fact, going to be utilized. For at least these reasons of cost and frequency of use, it is considered that providing two separate and distinct control and display systems is not efficient. This is also true in other types of combined appliance units. However, the possibility of utilizing a single control and display system for multiple appliance units can raise some further concerns, such as how information is clearly conveyed to the user regarding which unit is being controlled or, if both units are being utilized, how the units are separately programmed.

Based on the above, there exists a need in the art of appliances for a control system that can be efficiently and effectively used to program and display operational information for multiple appliance units utilizing a common control and display unit.

SUMMARY OF THE INVENTION

In accordance with the present invention, multiple appliance units are provided with a common program control and display system. In a preferred form of the invention, the program control and display system is utilized in connection with upper and lower ovens incorporated in a range which also includes various surface heating elements, with the system including a control unit programmed with priority and over-ride features for enhancing the operation of the range. In accordance with the invention, a control panel is provided with an alpha-numeric display having certain zones dedicated to convey information concerning the operation of a respective one of the ovens, as well as at least one common display zone used to convey information concerning either of the ovens. In order that the user can be certain which oven the common display zone refers to, an information link is incorporated as part of the display. In accordance with a preferred embodiment of the invention, the information link takes the form of a display bracket extending from a dedicated display zone to the common display zone in order to indicate that the information presented in the common display zone reflects an operational feature or the like about the oven associated with the dedicated zone.

In addition to providing an enhanced display arrangement, the control system of the present invention is designed to ease the inputting of programming information by a user, as well as to convey status information to the user. Preferably, these programming features work in conjunction with the information link to establish a desired operational mode for either or both of the ovens. For instance, if the information link is associated with the upper oven which is operating in a baking mode, the user can readily alter the bake time or temperature without requiring the activation of a dedicated bake establishing control element. On the other hand, if the information link is associated with the upper oven and changes are desired to the operation of the lower oven, the information link can be shifted to reflect that any engaged time or temperature controls will affect the lower oven. In the most preferred embodiment of the invention, one of the ovens, such as the upper oven, is established as a higher priority oven such that the information link will default to a position associated with this oven after the programming operation is complete. Furthermore, system fault messages are also given priority.

Additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE PREFERRED EMBODIMENT

Figure 1:
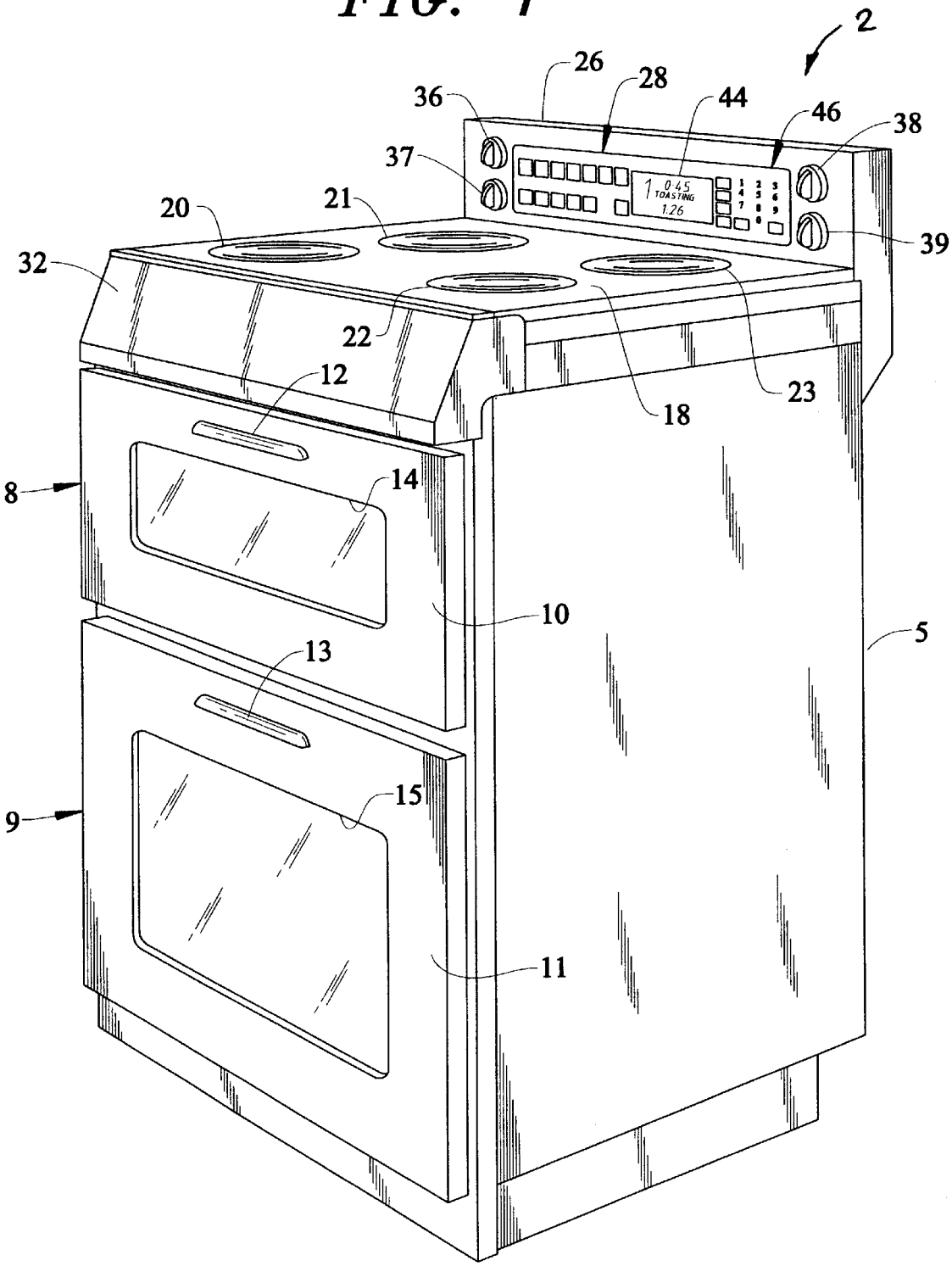
FIG. 1 is a perspective view of an electric range incorporating the program control and display system of the present invention.

With initial reference to FIG. 1, the invention is illustrated for use in connection with an electric range generally indicated at 2. In the embodiment shown, electric range 2 includes a cabinet 5 within which is arranged a first or upper oven 8 and a second or lower oven 9. Upper and lower ovens 8 and 9 have associated doors 10 and 11 which are respectively provided with handles 12 and 13 that can be used to pivot doors 10 and 11 in order to access respective cooking chambers of ovens 8 and 9. For the sake of completeness, this figure illustrates doors 10 and 11 with respective viewing windows 14 and 15.

Cabinet 5 is also provided with an associated range top 18 which supports various spaced surface heating elements 20–23 in a manner known in the art. At an upper rear portion, cabinet 5 includes an upstanding portion 26 which is provided with a control panel 28. At this point, it should be realized that the arrangement and location of control panel 28 could vary in accordance with the present invention. For example, control panel 28 could be located along an upper face panel 32 of cabinet 5. In any event, upstanding portion 26 includes a plurality of knobs 36–39 for use in selectively activating and deactivating surface heating elements 20–23 respectively. Control panel 28 is preferably arranged between knobs 36–39 and is shown to include a substantially central display 44, such as an LED, LCD or VFD display unit. Furthermore, control panel 28 is provided with a number pad generally indicated at 46 that has an associated button 48 for use in setting a clock arranged either within display 44 or in another portion of control panel 28.

Figure 2:
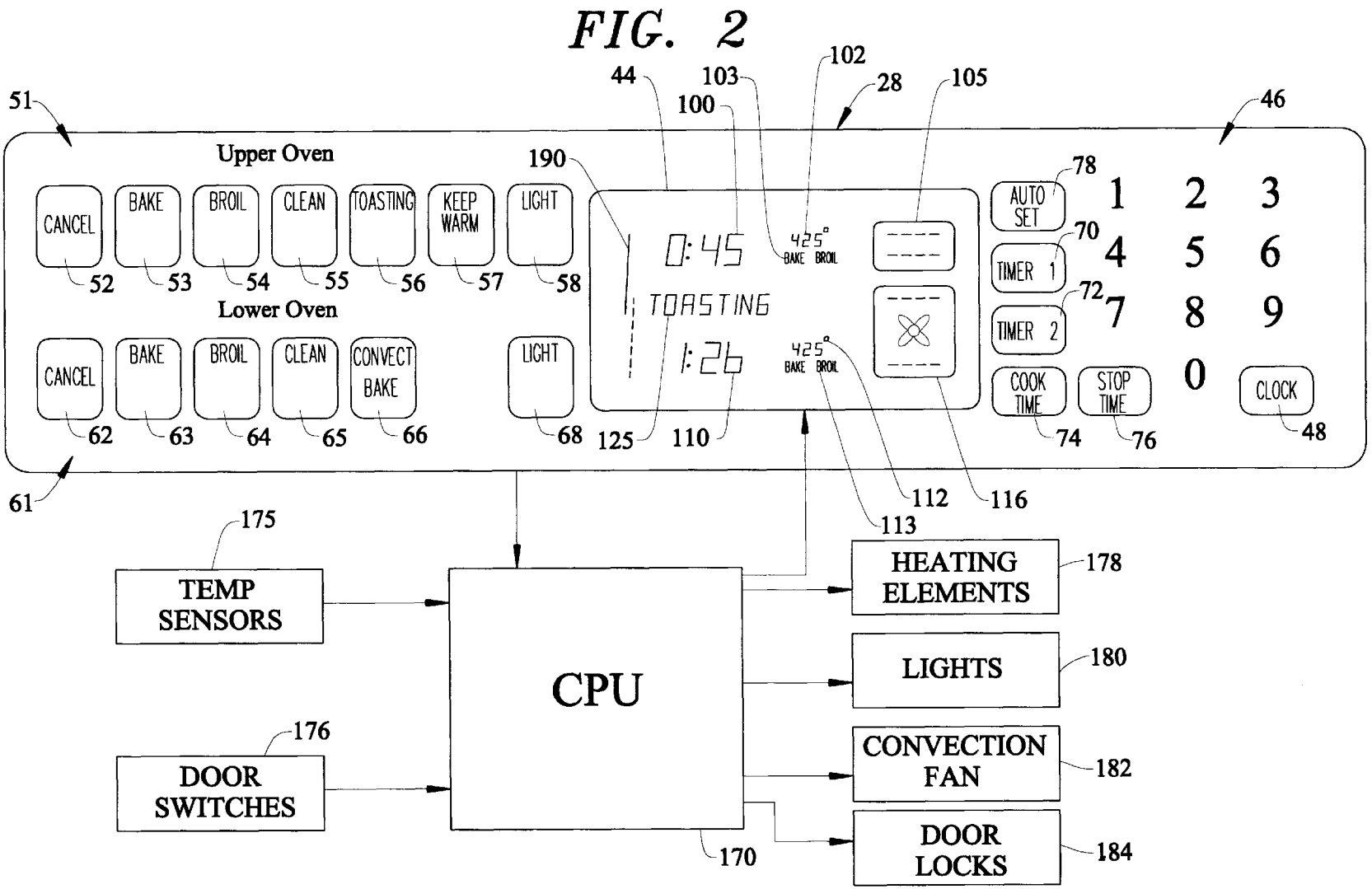
FIG. 2 is a generally schematic view of the program control and display system according to a preferred embodiment of the invention.

In more detail and particularly with reference to FIG. 2, control panel 28 of range 2 includes a first row of control buttons generally indicated at 51 which are generally used to establish an operational mode for upper oven 8. As shown, first row 51 includes a cancel button 52, a bake button 53, a broil button 54, a cleaning mode button 55, a toasting button 56, a warming mode establishing button 57 and a light control button 58. In a generally similar manner, a second row of control buttons 61 are provided for lower oven 9. In the most preferred form of the invention, second row 61 includes a cancel button 62, a bake button 63, a broil button 64, a cleaning mode button 65, a convection mode establishing button 66 and a light control button 68. In the most preferred form of the invention, the user is able to program the operation of at least upper and lower ovens 8 and 9 through the use of the first and second rows of buttons 51 and 61, along with numeric pad 46, timer buttons 70 and 72, cook time and stop time buttons 74 and 76, and an auto set button 78. Since this basic programming arrangement is known in the art and not considered part of the present invention, it will not be described further here in detail. Of course, as also known in the art, light buttons 58 and 68 enable a consumer to selectively activate lights (not shown) provided in upper and lower ovens 8 and 9 respectively, with the lights being usable in combination with windows 14 and 15 to view the progress of a cooking operation.

FIG. 2 illustrates additional details of the program control and display system of the present invention which will now be described in detail. First of all, it should be noted that display 44 is provided with numerous display zones. As will be detailed more fully below, some of these zones provide information which relates to the operation of only a particular one of ovens 8 and 9, while at least one display zone represents a common area for displaying information for a selected one of the ovens 8 and 9. In accordance with the invention, display 44 visually links the common area to a respective one of the dedicated areas in order to convey to the user exactly which oven 8, 9 the information displayed in the common area relates to.

More specifically, display 44 includes a first display zone 100 which is used to convey programmed timing information for upper oven 8. Zone 100 can also be used as a clock display area, at least during non-oven use periods, as well as countdown time data established through timer button 70 independent of oven operation. Adjacent first display zone 100 is a second display zone 102 which is arranged above a third display zone 103. Second display zone 102 preferably defines a numeric temperature display area for oven 8, while zone 103 defines an alpha display used to convey certain operational mode information for oven 8. Slightly offset from zones 102 and 103 is a fourth display zone 105. In the most preferred form of the invention, zone 105 is boxed off and capable of displaying upper and/or lower generally horizontal bars which reflect the activation status of upper and/or lower heating elements (not shown) provided within upper oven 8. Therefore, depending upon which mode button 53–57 is depressed, zone 105 will indicate the corresponding activation of either or both of the upper and lower heating elements for upper oven 8.

Display 44 includes a fifth display zone 110 which generally functions in a manner corresponding to first display zone 100 in that zone 110 conveys programmed time information. However, zone 110 is dedicated to convey information for lower oven 9. Adjacent zone 110 are sixth and seventh display zones 112 and 113. Zone 112 is used to convey temperature information for lower oven 9, such as the temperature set by a user utilizing numeric pad 46. The selected operational mode for lower oven 9 is displayed in display zone 113. Therefore, if lower oven 9 is to be used to bake some food product at 425° F., zone 112 would numerically display the temperature and zone 113 would display the word "BAKE". Adjacent zones 112 and 113 is another boxed area which constitutes display zone 116. Zone 116 is provided with upper and lower bar displaying portions for conveying information concerning the activation/deactivation of upper and lower heating elements (not shown) provided in lower oven 9 in a manner directly analogous to zone 105. In addition, zone 116 can also display a symbol indicative of the activation of a convection fan (not shown) for lower oven 9 upon depression of mode button 66. In any event, zone 116 is dedicated to displaying information relating to lower oven 9.

At this point, it should be noted that the number, form, content and particular arrangement of the various zones of display 44 can greatly vary in accordance with the invention such that the drawings and above description merely set forth the most preferred arrangement. Due to the construction of display 44 in accordance with the most preferred form of the invention, zones 103 and 113 only provide dedicated information concerning selected operational modes for upper oven 8 and lower oven 9 respectively. Most preferably, zones 103 and 113 are limited to displaying "BAKE" and "BROIL" operational modes for the upper and lower ovens 8 and 9. In order to be able to convey additional alpha information, display 44 includes a common, central zone 125 that is used to display operational information for each of upper and lower ovens 8 and 9. As will be detailed more fully below, common zone 125 preferably has an associated default, in accordance with the preferred embodiment, which results in the displaying of information concerning the current operational mode for upper oven 8.

Selections inputted by the user of range 2 through control panel 28 are relayed to a central processing unit (CPU) 170. CPU 170 also receives other signals, such as signals indicative of the temperatures in upper and lower ovens 8 and 9 from sensors 175 and door opening/closing status signals from switches 176 associated with both oven doors 10 and 11. Based on the signals received, CPU 170 outputs control signals to heating elements associated with upper and lower ovens 8 and 9 as indicated at 178, lights for ovens 8 and 9 as indicated at 180, a convection fan as indicated at 182, door locks as indicated at 184 and to display 44. In general, the invention is concerned with providing and controlling the display in common zone 125 and the manner in which the information displayed in common zone 125 is linked to a particular one of ovens 8, 9 as will be detailed below.

As shown, common display zone 125 is preferably located between dedicated zones 100 and 110. Due to this location and the use of zone 125 to display alpha information for both upper and lower ovens 8 and 9, display 44 also incorporates structure used to link information in common display zone 125 with display information for a respective one of the upper and lower ovens 8 and 9. In accordance with the most preferred form of the invention, an information link in the form of a display bracket 190 is provided. In FIG. 2, common zone 125 illustrates that a "TOASTING" operation has been selected and bracket 190 extends from first display zone 100 to common zone 125 thereby linking the display information in common zone 125 to upper oven 8. Of course, a corresponding bracket arrangement would be used to link common zone 125 to dedicated display zone 110 when the information provided in common zone 125 relates to the operation of oven 9 as indicated by the dotted lines in this figure.

Common zone 125 is actually used to display numerous messages to a user of range 2, with the displayed information being presented on a predetermined priority basis. That is, an array of words and phrases that are displayed in a priority viewing basis, based on ease of use and convenience, is available for common zone 125. Range 2 allows multiple cooking functions and timed features to be active simultaneously with the highest priority alpha message being displayed in common zone 125. In accordance with the most preferred embodiment, there are three primary priority displays, at least one override message and appliance fault indications. To indicate the operation of upper oven 8, common zone 125 can display "TOASTING" and "KEEP WARM" messages. For lower oven 9, "CONVECTION" is available for display. In addition, common operational messages of "CLEANING", "CLEANED" and "PREHEAT" are available.

In the example shown, the alpha display zone 125 indicates that a "TOASTING" mode has been selected. Information link bracket 190 indicates that the toasting operation is associated with the upper oven. This alpha display would be maintained for the entire operation unless the user alters the cooking functions. If additional time is desired for the already established mode of operation, numeric pad can be directly accessed and, utilizing the toasting operation shown in FIG. 2 as an example, the toast time could be changed directly without having to further press mode button 56. If it is desired to adjust the operation of lower oven 9, the suitable mode button 63, 64 or 66 would be depressed, the bracket 190 would extend across the common area 125 and dedicated zone 110 (see lower bracket shown in dotted lines in FIG. 2) and the other controls could be directly utilized to select the desired cook time and operation. After the programming is completed, bracket 190 would again return to the higher priority state associated with upper oven 8. After the toast time expires, the word "TOASTING" would be changed to "COMPLETE", preferably followed by a user selectable set of reminder beeps. The word "COMPLETE" would be removed from common display zone 125 and the beeps would terminate simply by opening of the oven door 10 as sensed by switch 176. Therefore, "TOASTING", "KEEP WARM" and "CONVECTION" represent priority displays, "COMPLETE" is an override display and appliance faults indications such as sensor errors, door open conditions and the like also take priority over programmed information.

Of course, the particular information that can be displayed in common zone 125 could vary in accordance with the present invention, particularly when the invention is applied to different types of appliances. In general, the invention is concerned with providing common display zone 125, the manner in which alpha messages are provided in zone 125 and the ability to link the information in common display zone 125 to one of the upper and lower ovens 8 and 9. Again, this linking arrangement is performed through the use of bracket 190 in accordance with the most preferred embodiment of the invention. Regardless, the provision of the common display zone 125 not only reduces the cost of the overall display 44 but conveniently provides a common display area to which a user can consistently direct his/her attention during programming of the appliance through control panel 28 and when updating or receiving status information concerning the operation of the overall appliance.

Although described with respect to the preferred embodiment of the invention, it should be readily understood that various changes and/or modifications can be made to the invention without departing from the spirit thereof. For example, although the invention has been described with respect to range 2, the invention also has applicability to other types of appliance units including gas ranges, wall ovens, fresh food and freezer controls for a refrigerator, combination clothes washers/dryers and the like. Certainly, other types of information links could be utilized, without departing from the invention. In general, the invention is only intended to be limited by the scope of the following claims.

We claim:

1. A program control and display system for first and second, independently operable appliance units comprising:

a control panel including a plurality of user control elements for inputting operational information, including an operational mode and an operational time, for each of the first and second appliance units;

a control unit, linked to the control elements, for receiving input signals representative of the desired operational modes and times;

an alpha-numeric display unit interconnected to the control unit for conveying the operational modes and times selected by the user, said display unit including at least first, second and third distinct display zones, with said first and second display zones being dedicated to displaying operational information solely for the first and second appliance units respectively and said third display zone representing a common display zone capable of displaying operational information for either of the first and second appliance units; and an information link formed as part of the display unit, said information link connecting the third display zone and one of the first and second display zones.

2. The program control and display system according to claim 1, wherein said information link visually interconnects the display zone and one of the first and second display zones.

3. The program control and display system according to claim 2, wherein the third display zone is interposed between the first and second display zones.

4. The program control and display system according to claim 3, wherein the information link constitutes a bracket extending from the third display zone into a respective one of the first and second display zones.

5. The program control and display system according to claim 3, wherein the first and second display zones constitute numeric display areas.

6. The program control and display system according to claim 5, wherein the third display zone constitutes an alpha display area.

7. The program control and display system according to claim 1, wherein the third display zone constitutes an alpha display area.

8. The program control and display system according to claim 7, wherein the control unit regulates the operational information conveyed in the third display zone on a predetermined priority basis.

9. The program control and display system according to claim 8, wherein the operational information conveyed in the third display zone defaults to the operational information for the first appliance unit, at least when the first appliance is activated and no programming operation is being performed for the second appliance unit.

10. The program control and display system according to claim 8, wherein the control system replaces user programmed operational information presented in the third display zone to convey information concerning appliance faults.

11. The program control and display system according to claim 8, wherein the control system over-rides user programmed operational information presented in the third display zone to convey a completion of a programmed operation for either of the first and second appliance units.

12. The program control and display system according to claim 7, wherein the control system permits direct entry of timing changes for an operational mode displayed in the common zone.

13. The program control and display system according to claim 1, wherein the display unit includes additional display zones for conveying to a user dedicated operational modes for the first and second appliance units respectively.

14. A method of controlling and displaying operational mode and timing information programmed for first and second appliance units comprising:

displaying operational information in a first display zone dedicated for the first appliance unit;

displaying operational information in a second display zone dedicated for the second appliance unit;

displaying operational information from at least one of the first and second appliance units in a third, common display zone; and visually linking the operational information displayed in the common display zone with a respective one of the first and second display zones.

15. The method according to claim 14, further comprising: bracketing the common display zone with the respective one of the first and second display zones in order to visually link the operational information.

16. The method according to claim 14, further comprising: displaying operational information in the common display zone on a predetermined priority basis.

17. The method according to claim 16, further comprising: having the common display zone default to displaying operational information of the first appliance unit, at least during non-programming periods of the second appliance unit.

18. The method according to claim 16, further comprising: overriding the operational information displayed in the common display zone to convey a completion of a programmed operation for either of the first and second appliance units.

19. The method according to claim 16, further comprising: overriding the operational information displayed in the common display zone to convey a fault condition of either of the first and second appliance units.

20. The method according to claim 14, further comprising:

selected a desired appliance operation by inputting operational information for at least one of the first and second appliance units through the use of operational mode and operational time control elements provided on a control panel; and permitting the operational time for the selected operational mode to be directly adjusted during the appliance operation so long as the operational mode is currently displayed in the common display zone.

* * * * *